United States Patent [19]

Barker

[11] 4,321,219

[45] Mar. 23, 1982

[54] STEAM CLEANER

[76] Inventor: Richard M. Barker, 6/3 Frances St., Randwick, New South Wales 2031, Australia

[21] Appl. No.: 211,885

[22] Filed: Dec. 1, 1980

[30] Foreign Application Priority Data

Dec. 3, 1979 [AU] Australia ..... PE1564

[51] Int. Cl.[3] ..... B01F 3/04

[52] U.S. Cl. ..... 261/18 B; 15/321; 137/142; 137/215; 137/217; 137/434; 137/625.37; 251/63; 251/324; 261/64 R; 261/70; 261/DIG. 26; 261/DIG. 76

[58] Field of Search ..... 261/18 B, 64 R, 70, 261/DIG. 13, DIG. 26, DIG. 76; 15/320, 321; 137/142, 143, 215, 217, 434, 625.37; 251/63, 324; 122/487

[56] References Cited

U.S. PATENT DOCUMENTS

| | | | |
|---|---|---|---|
| Re. 26,950 | 9/1970 | Hays | 15/321 |
| 1,511,302 | 10/1924 | Schnetzer | 137/625.37 |
| 1,767,270 | 6/1930 | Woodsome | 137/625.37 X |
| 2,455,754 | 12/1948 | Glover, Jr. | 261/DIG. 76 |
| 2,483,426 | 10/1949 | Moore | 261/DIG. 76 |
| 2,571,575 | 10/1951 | Holmes | 15/321 X |
| 2,651,511 | 9/1953 | Glover, Jr. et al. | 261/DIG. 13 |
| 2,916,268 | 12/1959 | Pedrick | 261/18 B |
| 3,439,374 | 4/1969 | Wisdom | 15/321 |
| 3,904,722 | 9/1975 | Onoda et al. | 261/64 R |
| 4,257,452 | 3/1981 | Hill et al. | 137/625.37 X |

*Primary Examiner*—Richard L. Chiesa
*Attorney, Agent, or Firm*—Ladas & Parry

[57] ABSTRACT

Steam cleaning equipment comprising a water reservoir incorporating steam and water inlet ports and steam and water outlet ports arranged to supply steam at a controlled pressure and water in predetermined quantities to a hand piece where they are mixed in a venturi nozzle.

A steam pressure reducing valve in the reservoir is immersed in the water and operated by steam pressure on a piston which has no sealing rings but which condenses steam leaking past the piston and passes the condensate into the reservoir.

Detergent metering means and anti-siphon provisions are also described.

9 Claims, 3 Drawing Figures

STEAM CLEANER

This invention relates to an improved steam cleaner and particularly a steam cleaner of the type which uses steam from an independent source.

There are two basic types of steam cleaner, one of which has a built-in steam generator and the other of which uses steam from a separate source. This invention is concerned with the latter type of steam cleaner. In the past steam cleaners of the type have employed a boiler feed-water injector to heat and pressurize the cleaning solution (e.g. water plus detergent) which is then conveyed to a hand piece through a steam hose. This type of apparatus has the disadvantage that boiler feed-water injectors are temperamental in use and are prone to erosion or misalignment of the internal passages causing problems in operation.

It is therefore an object of the present invention to provide steam cleaning equipment which will obviate or minimise the foregoing disadvantages in a simple yet effective manner or which will at least provide the public with a useful choice.

Accordingly the invention consists in steam cleaning equipment comprising water reservoir with inlet and outlet ports for water and steam, a water level control valve connected to the water inlet port and arranged to maintain a quantity of water in said reservoir within predetermined limits, a steam pressure regulating valve connected between the steam inlet port and the steam outlet port, said steam pressure regulating valve comprising a cylindrical body, a piston slidable within said body against the action of a biassing means, a choke ring located in a conduit between said steam inlet port and said steam outlet port and a valve head connected to said piston and operatively associated with said choke ring to choke the flow of steam therethrough when said piston is moved in said body against said biassing means, said body being at least partially immersed in water in the reservoir in use so that steam leaking past said piston is condensed and passes out of the valve body into the reservoir.

Notwithstanding any other forms that may fall within its scope, one preferred form of the invention will now be described with reference to the accompanying drawings in which.

Figure 1:
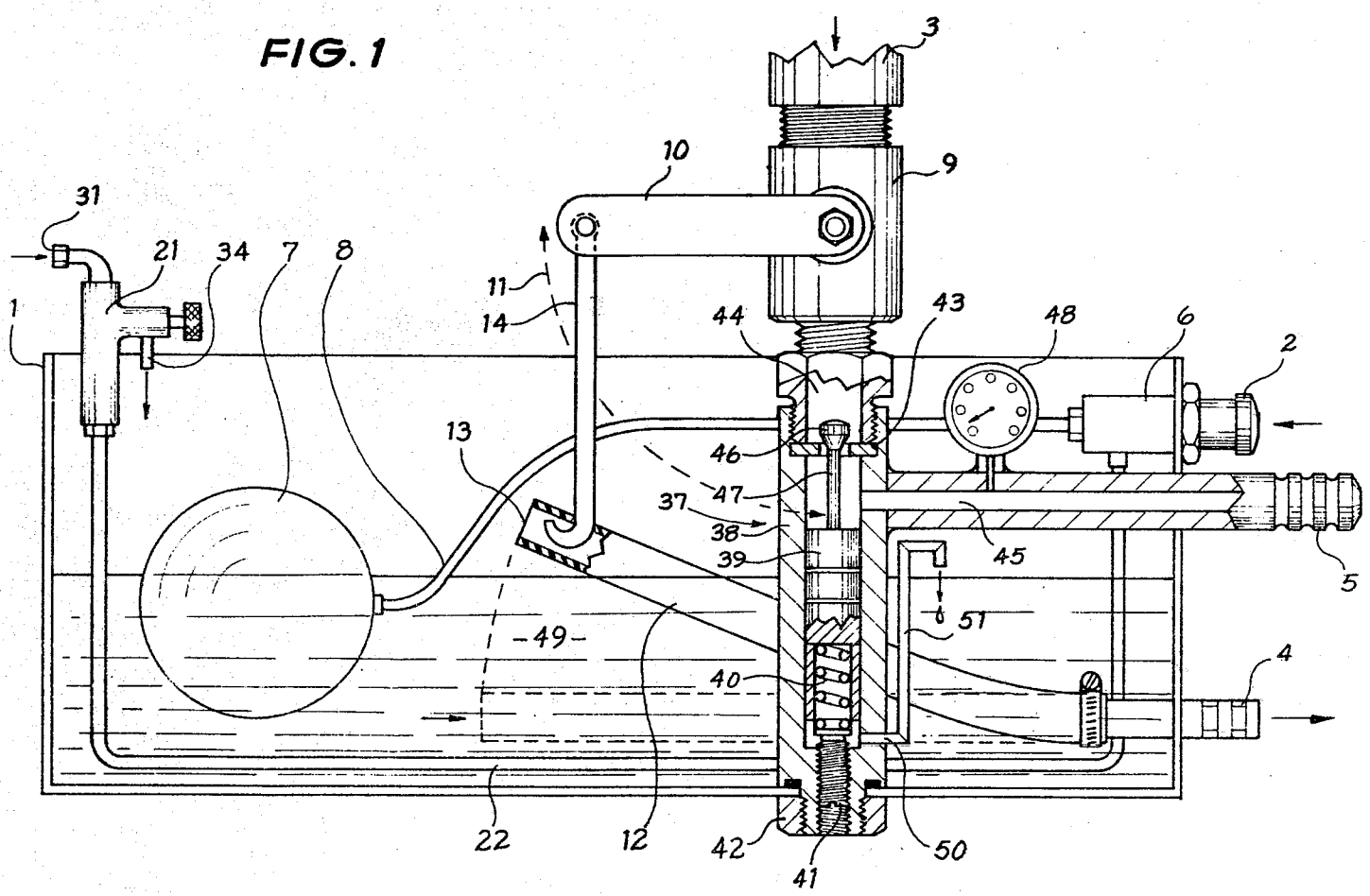
FIG. 1 is a diagrammatic cross-sectional elevation of steam cleaning equipment according to the invention.

In the preferred form of the invention, steam cleaning equipment is provided which dispenses with the boiler feed-water injector commonly used in previous equipment and conveys steam at a controlled pressure and water (which may include a cleaning solution) to a hand piece through separate hoses where the steam and water are mixed and expelled from the hand piece by a venturi type nozzle. Since normal steam hose has a working pressure of approximately 400 KPA or 60 PSI and most steam boilers deliver steam at over 100 PSI, a steam pressure regulating valve must be used to reduce the pressure to an acceptable figure. A conventional pressure regulating valve could be used in this application but would be expensive, bulky and in need of periodic maintenance.

The equipment of the present invention provides apparatus whereby steam and water may be supplied to separate inlet ports on the equipment which controls the steam pressure and dispenses steam and water through outlet ports to the hand piece as previously described. As an optional feature the equipment also provides detergent mixing and dispensing apparatus to mix detergent or other cleaning solution with the water as required.

Accordingly in the preferred form of the invention there is provided a water reservoir 1 having a water inlet port 2, a steam inlet port 3, a water outlet port 4 and a steam outlet port 5. The water inlet port 2 is connected to a water level control valve which, in the preferred form of the invention, comprises a float controlled valve 6 connected to a float 7 by a float rod 8 so as to control the level of water within the reservoir between predetermined limits in a manner commonly known and used in cisterns of many types.

The steam inlet port 3 is connected to a steam stop valve 9 of the ball type operable by an actuating lever 10 between a closed position as shown in FIG. 1 and an open position wherein the outer end of the lever 10 is moved downwardly through an arc shown in broken outline at 11.

Figure 2:
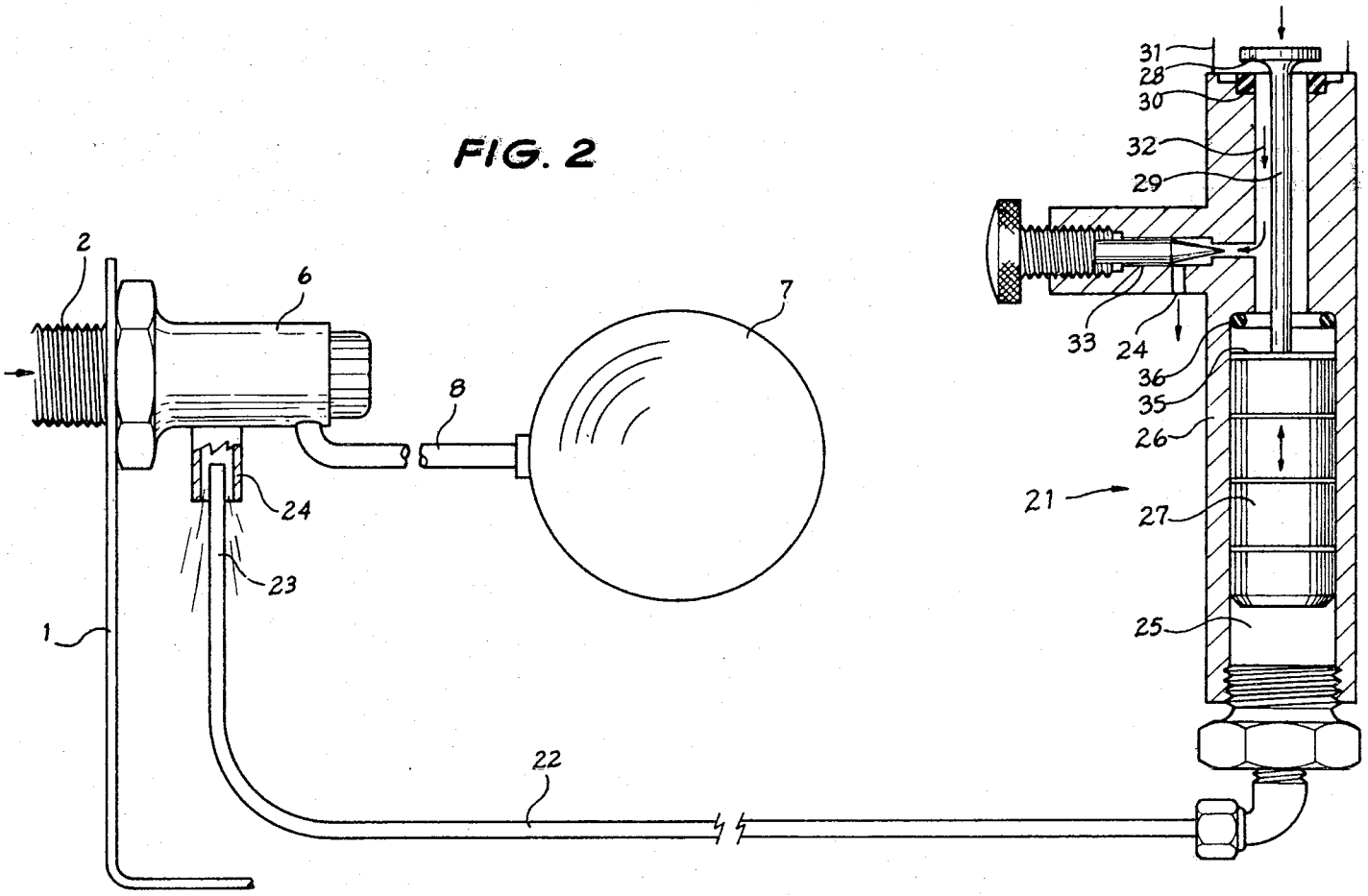
FIG. 2 is a partial diagrammatic cross-sectional elevation to an enlarged scale of the water inlet valve and detergent dispenser used in the apparatus shown in FIG. 1.
Figure 3:
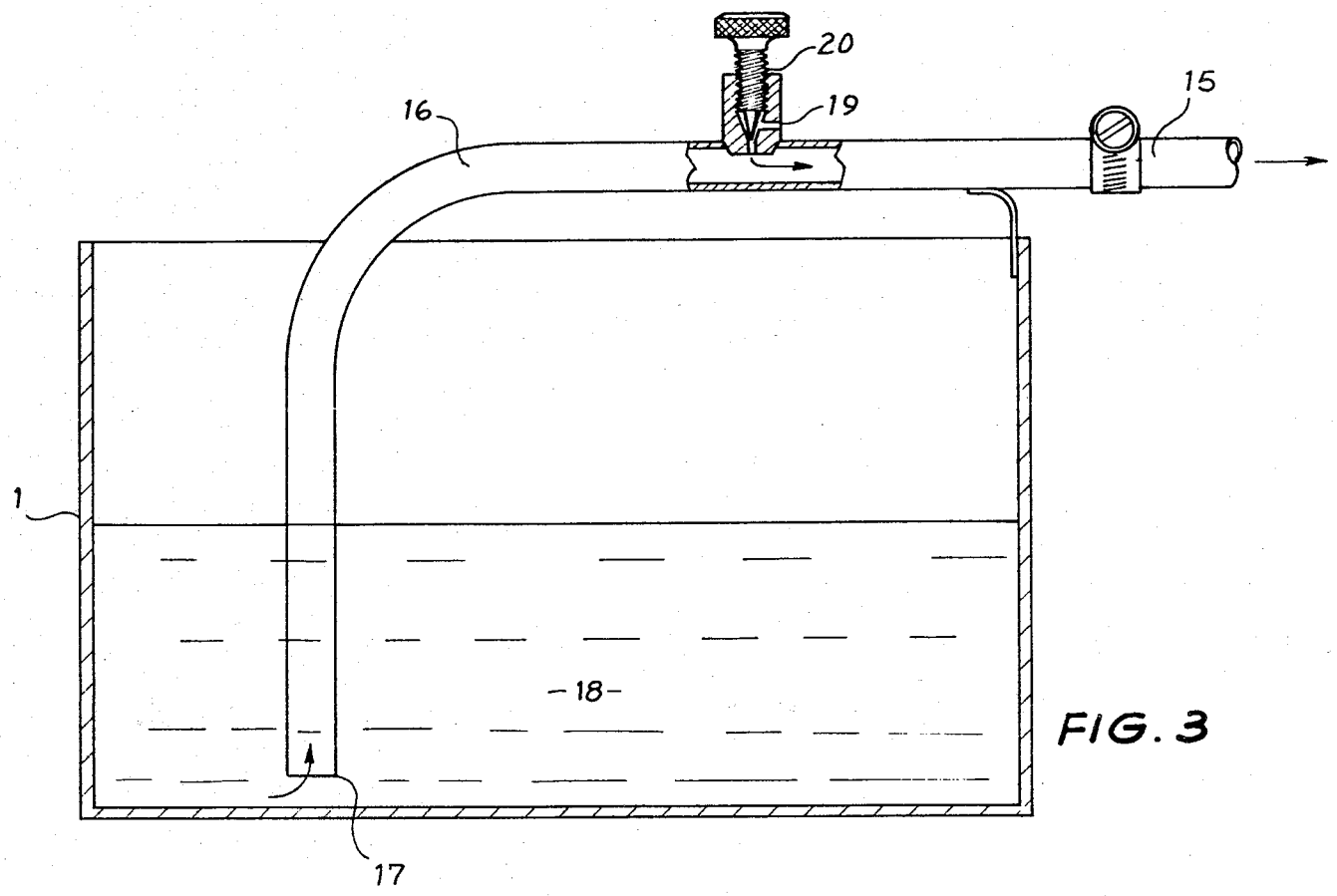
FIG. 3 is a diagrammatic cross-sectional elevation of an alternative form of water outlet from the apparatus shown in FIG. 1.

The water outlet port 4 is connected to a flexible hose 12 having one end 13 supported by a hook 14 connected to the steam valve actuating lever 10 so that when the lever 10 is in the horizontal position and the steam valve 9 is closed, the inlet end of the hose 12 is raised above the water level to prevent siphoning of water from the reservoir 1 when the equipment is not in use. In an alternative form of the invention as shown in FIG. 3, the water outlet port is shown at 15 and is connected to a conduit 16 which is turned downwardly so that the lower end 17 of the conduit is immersed in the water 18 contained within the reservoir 1. The conduit 16 may be provided near its highest point with a small inlet hole to prevent siphoning of water through the conduit. In the preferred form of this alternative form of the invention, the anti-siphoning hole is provided at 19 and is controlled by way of a needle valve 20 to control the quantity of air entering the conduit 16. By controlling the in-flow of air through the needle valve 20 into the conduit 16, the quantity of water or cleaning solution passing through the outlet port 15 can also be controlled. This feature is important since by varying the quantity of solution entrained by the steam in the nozzle of the hand piece, its velocity can also be controlled or varied. In order to retain the anti-siphoning function of the air inlet hole 19 when the needle valve is closed, a separate air hole (not shown) may be provided in the conduit 16 or the needle valve can be arranged to admit sufficient air when closed to break any vacuums that may otherwise be formed in the conduit 16. The air bleed into the conduit 16 may, of course, take many other forms, for example, a series of small holes could be provided in a line along the conduit 16 which could be progressively covered and uncovered by a suitable slide.

Where it is desired to mix detergent or other cleaning fluid with the water in the reservoir, the apparatus is provided with a detergent dispenser 21 (FIG. 1) which is shown in greater detail in FIG. 2. The detergent dispenser is connected to the level control valve 6 by way of a tube 22 having one end 23 inserted into the outlet 24 from the level control valve 6. When water is admitted to the reservoir by the control valve 6, pressure is built-up in the outlet 24 because of partial choking by the end 23 of the tube 22. This pressure is transmitted through the tube 22 to the detergent dispenser 21 where it is admitted to the lower chamber 25 of the dispenser body 26.

The detergent dispenser comprises a cylindrical body 26 in which is slidably mounted a piston 27 connected to a valve head 28 by means of a rod 29. The valve head 28 is operatively associated with a valve seat 30 to control the flow of detergent from an inlet or reservoir 31 through a passage 32 and hence through a needle valve 33 to an outlet 34 which opens downwardly into the reservoir 1.

Upon water being admitted to the reservoir through the level control valve 6, water pressure is transmitted through the tube 22 into the chamber 25 raising the piston 27 and opening the valve head 28 allowing detergent to flow from the inlet 31 through the flow rate controlling needle valve 33 and hence into the reservoir through the outlet 34. It is a feature of the detergent dispenser that the piston need not be provided with sealing rings which would be inclined to gum-up and jam as the head 35 of the piston contacts a sealing ring 36 when the piston is lifted by water pressure so preventing water from entering the detergent stream. In the event of piston 27 sticking in the body 26 due to solidification of the detergent due to lack of use or for other reasons, water can pass around the piston 27 to flush out unwanted material whereupon the dispenser will again function normally.

Returning to FIG. 1 it will be seen that the steam stop valve 9 is connected to a steam pressure regulating valve 37 having a cylindrical body 38 in which is slidably mounted a piston 39. The piston is slidable downwardly against the action of biassing means in the form of a compression spring 40, the tension of which may be adjusted by a screw 41 rotatable in a female thread in the lower end of the valve body by an adjusting nut 42.

The valve body is provided with a choke ring 43 located in a conduit 44 between the ball valve 9 and an outlet 45 to the steam outlet port 5. A valve head 46 is provided in association with the choke ring 43 and is connected to and movable by the piston 39 by way of a rod 47. Pressure of steam passing into the regulating valve 37 through the ball valve 9 acts downwardly on the upper end of the piston 39 causing the piston to move downwardly against the biassing spring 40 and causing the valve head 46 to choke the flow of steam through the choke ring 43 to the outlet 45. In this manner the pressure of the steam passing through the outlet 45 to the outlet port 5 is controlled and may be varied by rotating the adjusting nut 42 to vary the operation of the biassing spring 40 on the piston 39. The outlet 45 may be provided with a steam pressure gauge 48 so that the pressure at the outlet may be readily determined.

It is a feature of the regulating valve 37 that there are no sealing rings provided between the piston 39 and the valve body 38. The piston is provided with circumferential grooves to deter the passage of steam past the piston to the lower end of the valve body but steam which does leak past the piston is condensed by virtue of the fact that the valve body is immersed in the water 49 contained within the reservoir 1. The condensed steam passes from the valve body into the water of the reservoir. In the preferred form of the invention the condensate outlet 50 is taken upwardly through a tube 51 so that it enters the reservoir at a height above the normal maximum water level in the reservoir to prevent siphoning of fluid containing detergent into the steam pressure regulating valve.

In use, the steam inlet port 3 is connected to a suitable supply of steam, for example, from a boiler and the water inlet port 2 is connected to a water supply. If desired detergent may be metered into the equipment as previously described through inlet 31. The steam outlet port 5 and the water outlet port 4 are connected through twin parallel hoses to a hand piece where they are mixed in a venturi type nozzle. The venturi effect of the nozzle draws water from the reservoir 1 at the desired flow rate which may be controlled by the needle valve 20.

The fact that no piston rings or seals are used in the apparatus assures high reliability and accuracy since no sticking occurrs in use. In addition to the automatic and variable detergent feed, the volume of solution reaching the nozzle of the hand piece is also variable from wet steam to solid liquid to suit the conditions. The anti-siphoning device in either of the forms shown alternatively in FIGS. 1 and 3, prevents loss of solution from the reservoir when the equipment is not in use.

What I claim is:

1. Steam cleaning equipment comprising a water reservoir with inlet and outlet ports for water and steam, a water level control valve connected to the water inlet port and arranged to maintain a quantity of water in said reservoir between said predetermined limits, a steam pressure regulating valve connected between the steam inlet port and the steam outlet port, said steam pressure regulating valve comprising a cylindrical body, a piston slidable within said body against the action of a biassing means, a choke ring located in a conduit between said steam inlet port and said steam outlet port and a valve head connected to said piston and operatively associated with said choke ring to choke the flow of steam therethrough when the piston is moved in said body against said biassing means, said body being at least partially immersed in the water in said reservoir in use so that steam leaking past said piston is condensed and passes out of the valve body into the reservoir.

2. Steam cleaning equipment as claimed in claim 1 wherein the outlet of condensate from said valve body into the reservoir is provided with a conduit passing upwardly from the condensate outlet to a point above the maximum water level in said reservoir so that water from said reservoir is prevented from passing in the reverse direction through the condensate outlet and into the steam pressure regulating valve.

3. Steam cleaning equipment as claimed in claim 1 wherein said water outlet port is provided with an anti-siphon device arranged to prevent the passage of water through said water outlet port when said equipment is not in use.

4. Steam cleaning equipment as claimed in claim 3 wherein said anti-siphon device comprises a flexible tube located within said reservoir and connected to said water outlet port, the end of said tube remote from the outlet port being raised above the level of the water in said reservoir when said equipment is not in use.

5. Steam cleaning equipment as claimed in claim 3 wherein said anti-siphon device comprises a water inlet located near the bottom of said reservoir and extending upwardly above the water level to the water outlet port through an outlet conduit, said outlet conduit being provided at or near its upper-most point by an air bleed aperture.

6. Steam cleaning equipment as claimed in claim 5 wherein said air bleed aperture is provided with control means to control the rate of air flow into the outlet conduit through the air bleed aperture.

7. Steam cleaning equipment as claimed in claim 1 wherein detergent dispensing means are provided arranged to dispense detergent into the water in said reservoir in a predetermined ratio to the water admitted through said level control valve.

8. Steam cleaning equipment as claimed in claim 7 wherein said detergent dispensing means incorporates a control valve which is opened by pressure supplied to a piston through a tube or conduit connected to the level control valve and operable by the pressure of water admitted to the reservoir through the level control valve.

9. Steam cleaning equipment as claimed in either claim 7 or claim 8 wherein the detergent dispensing means is provided with a flow rate control valve arranged to control the flow rate of detergent into said reservoir when said dispensing means is operated.

* * * * *